United States Patent [19]

Takeuchi

[11] Patent Number: 4,606,979

[45] Date of Patent: Aug. 19, 1986

[54] POROUS THIN FOIL AND METHOD FOR MANUFACTURING THE SAME

[76] Inventor: Tomokazu Takeuchi, 4-14-4, Ohgigaya, Kamakura-ski, Kanagawa, Japan

[21] Appl. No.: 782,909

[22] Filed: Oct. 2, 1985

[51] Int. Cl.[4] ..... B21B 1/38; B23P 15/16

[52] U.S. Cl. ..... 428/606; 428/613; 29/423; 29/163.5 R; 72/363

[58] Field of Search ..... 428/606, 613, 596; 29/423, 6.1, 163.5 R, 163.5 F; 72/363, 185, 186; 338/206; 361/220; 174/35 MS

[56] References Cited

U.S. PATENT DOCUMENTS

| | | | |
|---|---|---|---|
| 2,386,091 | 10/1945 | Carlson | 29/423 |
| 2,960,763 | 11/1960 | Reichl | 29/423 |
| 3,938,723 | 2/1976 | Slaughter | 29/423 |
| 3,964,284 | 6/1976 | Boultinghouse | 29/423 |

OTHER PUBLICATIONS

*Mechanical Metallurgy*, George E. Dieter, 2nd ed., McGraw-Hill Book Co., 1976, pp. 623-627.

*Primary Examiner*—L. Dewayne Rutledge
*Assistant Examiner*—John J. Zimmerman
*Attorney, Agent, or Firm*—Fred A. Keire

[57] ABSTRACT

A method for manufacturing a porous thin foil at least comprising a process for folding a first metallic plate having a large elongation percentage in half and putting a second metallic plate having a small elongation percentage between the folds of the folded first metallic plate, a process for cold-rolling a laminate of the folded first metallic plate and the second metallic plate put between the folds of the folded first metallic plate, and a process for separating a porous thin foil formed from the second metallic plate from the first metallic plate.

The porous thin foil thus formed has numerous elongate fissures extending perpendicular to the direction of rolling, and hence the porous thin foil has a fibrous construction.

13 Claims, 4 Drawing Figures

POROUS THIN FOIL AND METHOD FOR MANUFACTURING THE SAME

BACKGROUND OF THE INVENTION

1. Field of the Invention

The present invention relates to a porous thin foil having a novel construction and a method for manufacturing the same.

2. Description of the Prior Art

A known electromagnetic wave shielding material is formed by interlacing metallic wires in the form of a net. However, it is difficult to form such an electromagnetic wave shielding material in a very small thickness by metallic wires. A heating sheet is used as a surface heating element, however, since a thin heating sheet is unable to produce sufficient heat, such a heating sheet cannot be formed in a very small thickness. A foil capable of various purposes including the above-mentioned purposes has been desired.

SUMMARY OF THE INVENTION

The present invention has been made in consideration of the above-mentioned circumstances. Accordingly, it is an object of the present invention to provide a thin foil having a novel construction and capable of being used as an extremely thin electromagnetic wave shielding material or as a heating sheet, and a method for manufacturing such a thin foil.

The object of the invention is achieved by a porous thin foil having a plurality of fissures extending between the front surface and the back surface thereof, and a method for manufacturing such a porous thin foil, at least comprising: a process for folding a first metallic plate having a large elongation percentage in half and putting a second metallic plate having a small elongation percentage between the opposite folds of the folded first metallic plate; a process for cold-rolling the folded first metallic plate together with the second metallic plate put between the opposite folds of the folded first metallic plate; and a process for separating a porous thin foil formed from the second metallic plate from the folded first metallic plate after a plurality of cycles of cold rolling.

The above and other objects, features and advantages of the present invention will become more apparent from the following description of the preferred embodiments thereof taken in conjunction with the accompanying drawings.

DESCRIPTION OF THE PREFERRED EMBODIMENT

A preferred embodiment of the present invention will be described hereinafter in connection with the accompanying drawings.

Figure 1:
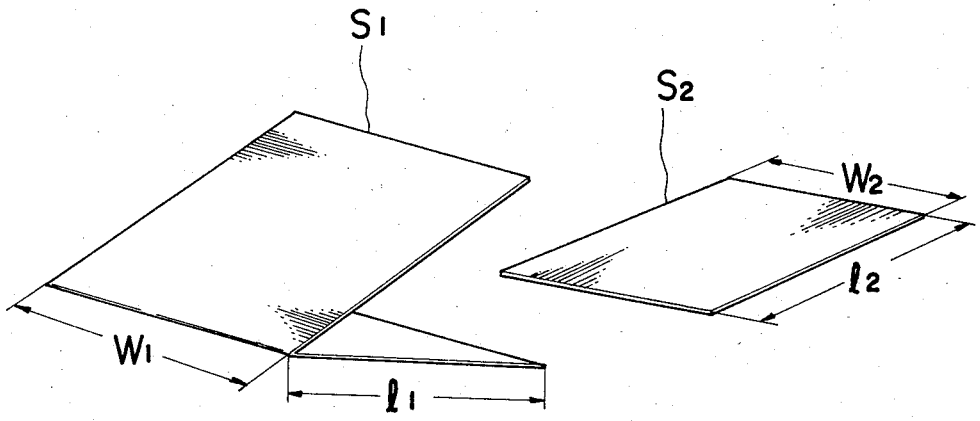
FIG. 1 is a perspective view of two materials in a preparatory stage of a method for manufacturing a porous thin foil, in a preferred embodiment, according to the present invention, in which a manner of combining the two materials is shown.

First, referring to FIG. 1, a soft copper plate $S_1$ is folded in half and a stainless steel plate $S_2$ is put between the folds of the folded soft copper plate $S_1$. In this embodiment, the folded soft copper plate $S_1$ has a length $l_1=15$ cm, a width $W_1=15$ cm and a thickness $t_1=0.6$ mm, while the stainless steel plate $S_2$ has a length $l_2=10$ cm, a width $W_2=10$ cm and a thickness $t_2=50$ $\mu$m.

Figure 2:
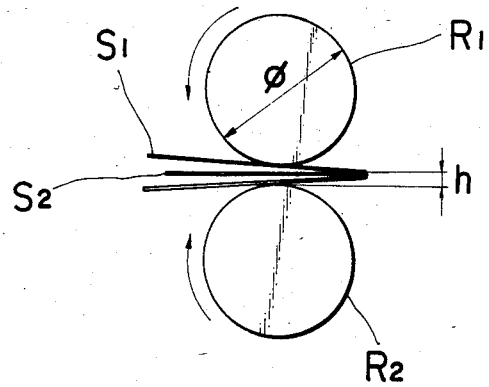
FIG. 2 is a side elevation showing the mode of rolling.

As shown in FIG. 2, a laminate of the folded soft copper plate $S_1$ and the stainless steel plate $S_2$ is subjected to rolling between a pair of cold-rolling rollers $R_1$ and $R_2$ each being 20 mm in diameter. The initial gap between the rollers $R_1$ and $R_2$ is 1.2 mm and the gap is reduced at a 0.1 mm-step after every roling cycle. Thus the laminate is rolled through sixteen rolling cycles.

In an experimental manufacture, the stainless steel plate $S_2$ held between the folds of the folded soft copper plate $S_1$ was extended in length to 32.8 cm, which is approximately three times the original length $l_2$, while the width $W_2$ remained unchanged. The stainless steel foil thus produced by rolling the stainless steel plate S was approximately 25 $\mu$m.

Figure 3:
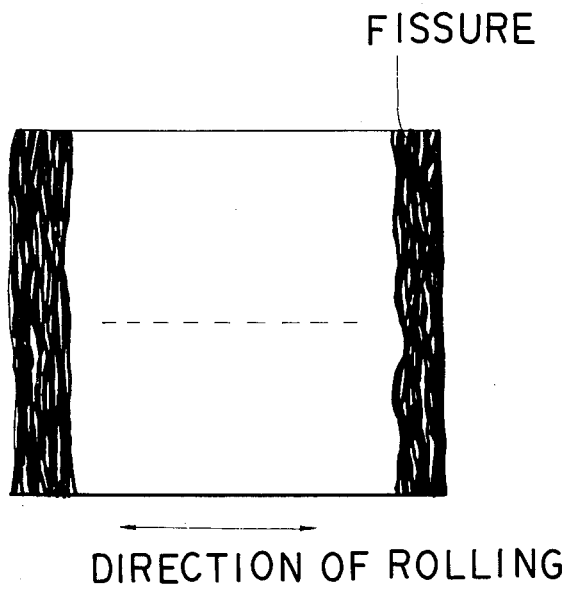
FIG. 3 is a typical illustration of a thin foil produced through experimental application of the method of the present invention.
Figure 4:
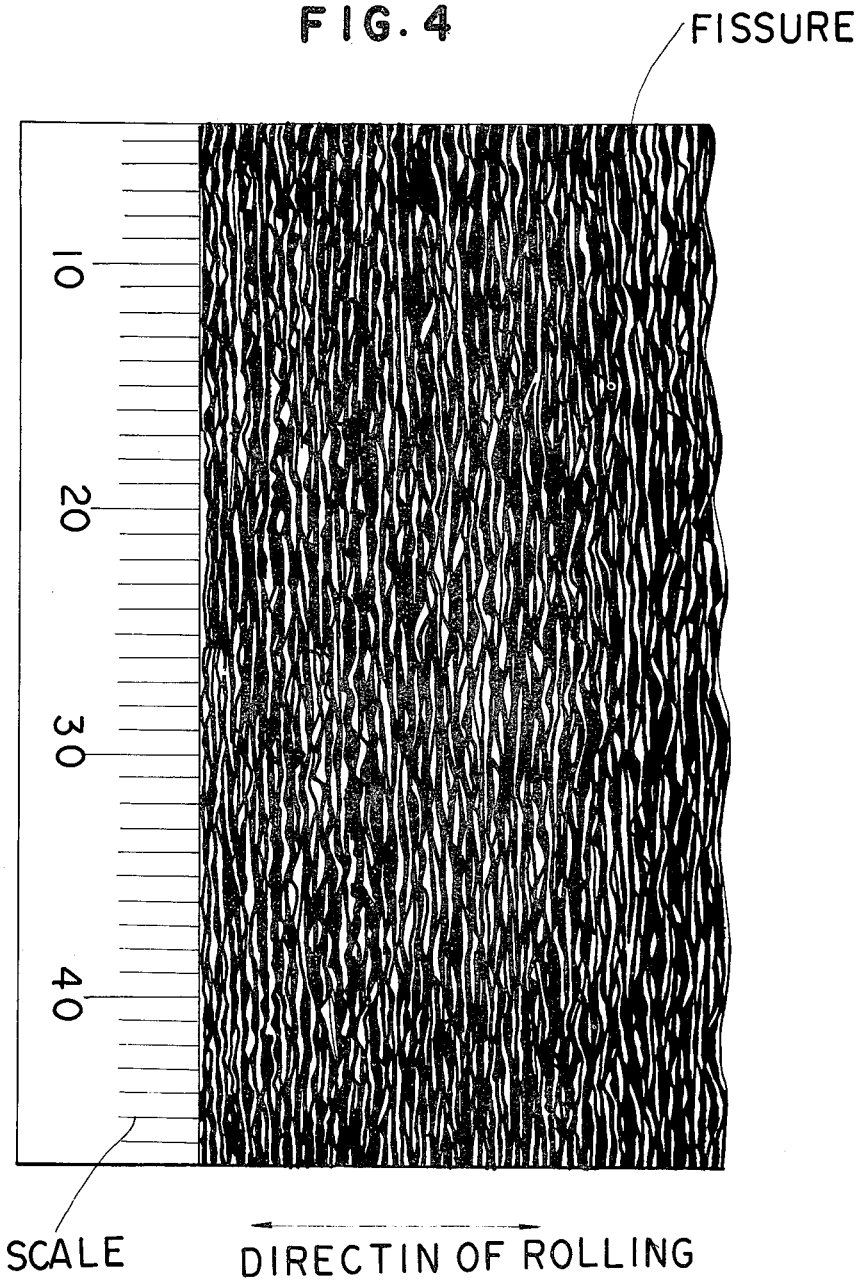
FIG. 4 is a photograph showing the surfacial morphology of a porous thin foil according to the present invention.

As shown in FIGS. 3 and 4 showing the surfacial morphology of the stainless steel foil produced by experimental rolling, numerous elongate fissures extending perpendicularly to the direction of rolling are formed in the stainless steel foil and the stainless steel foil has a fibrous construction. Thus, a transparent thin foil, namely, a porous thin foil, having numerous fissures was obtained. In FIG. 4, the blank portions are fissures.

Such a thin foil was obtained owing to the following reasons. A soft copper plate has a large elongation percentage, whereas a stainless steel plate has a small elongation percentage. Therefore, when the soft copper plate and the stainless steel are rolled together, the stainless steel plate is extended excessively as the soft copper plate is extended moderately, and hence numerous elongate fissures extending perpendicularly to the direction of rolling are formed in the stainless steel plate.

Experimental manufacture of porous thin foils were carried out for a combination of soft copper and a stainless steel and a combination of soft copper and permalloy. Conditions of the experimental manufacture were as follows.

(1) Soft Copper and Stainless Steel (a) Materials
Soft copper: Pure copper of 99% or above purity
Stainless steel: SUS316L (b) Elongation percentage
Soft copper: 90% or above
Stainless steel: 40% or above (c) Elongation percentage ratio:
1.5 or above (preferably 2.0 or above)

TABLE 1

| | | Results | | |
|---|---|---|---|---|
| | | Stainless steel plate | | |
| Rolling cycle | Roll gap (mm) | Length (mm) | Thickness ($\mu$m) | Appearance (fissures) |
| 0 | 1.2 | 100 | 50 | |
| 1 | 1.1 | 104 | 49 | |

TABLE 1-continued

| Rolling cycle | Roll gap (mm) | Results: Stainless steel plate Length (mm) | Thickness (μm) | Appearance (fissures) |
|---|---|---|---|---|
| 2 | 1.0 | 118 | 48 | |
| 3 | 0.9 | 124 | 47 | |
| 4 | 0.8 | 132 | 46 | |
| 5 | 0.7 | 156 | 45 | |
| 6 | 0.6 | 170 | 44 | |
| 7 | 0.5 | 170 | 43 | Fissures started developing |
| 8 | 0.4 | 182 | 42 | |
| 9 | 0.4 | 200 | 41 | |
| 10 | 0.3 | 230 | 40 | Fissures increased (30%) |
| 11 | 0.1 | 250 | 39 | |
| 12 | 0.1 | 270 | 38 | Fissures increased progressively |
| 13 | 0.1 | 280 | 35 | Fissures increased progressively |
| 14 | 0.1 | 320 | 30 | Fissures increased progressively |
| 15 | 0.1 | 320 | 28 | Fissures increased progressively |
| 16 | 0.1 | 328 | 25 | Porous foil was formed |

(2) Soft Copper and Permalloy (a) Materials

Soft copper: Pure copper of 99% or above purity

Permalloy: PB(Ni: 40 to 50%), PC(Ni: 70 to 80%)

(b) Elongation percentage

Soft copper: 90% or above

Permalloy: 40%

(c) Elongation percentage ratio 1.5 or above (preferably 2.0 or above)

TABLE 2

| Rolling cycle | Roll gap (mm) | Results: Permalloy Length (mm) | Thickness (μm) | Appearance |
|---|---|---|---|---|
| 0 | 1.2 | 100 | 50 | |
| 2 | 1.0 | 108 | 48 | |
| 4 | 0.8 | 121 | 46 | |
| 6 | 0.6 | 149 | 44 | Fissures started developing |
| 8 | 0.4 | 171 | 42 | |
| 10 | 0.4 | 200 | 40 | Fissures increased |
| 11 | 0.3 | 229 | 39 | |
| 12 | 0.1 | 249 | 38 | Fissures increased progressively |
| 14 | 0.1 | 278 | 30 | |
| 16 | 0.1 | 326 | 25 | Porous foil was formed |

The results of the first and second experiments were substantially the same. Fissures started developing at the sixth rolling cycle and fissures started increasing progressively from the tenth rolling cycle. After the fourteenth roling cycle, porous thin foils having such a surfacial morphology as shown in FIG. 4 were formed.

In the experiments, the roll gap h was reduced at a 0.1 mm-step in the rolling sequence from the first rolling cycle to the eighth rolling cycle, was kept unchanged for the ninth and tenth rolling cycles, was reduced at a 0.2 mm-step in the eleventh and twelfth rolling cycles and was held unchanged in the rolling sequence from the thirteenth rolling cycle to the sixteeth rolling cycle, to carry out the rolling operation smoothly so that the material will not be broken in pieces. In another experiment, the roll gap h was reduced at steps in the rolling sequence from the first rolling cycle to the eleventh rolling cycle so that the minimum roll gap is established at the eleventh rolling cycle. However, such a roll gap design was unable to form satisfactory fissures.

However, since the density of the fissures is dependent on the purpose of the porous thin foil and may be decided selectively, rolling conditions and the number of rolling cycles are not limited to those of the experiments. Essentially, a porous thin foil can be produced when the roll gap is reduced sequentially and the number of rolling cycles is ten or so.

Practically the same results as those with the above-mentioned combinations of metallic plates were obtained with the following combinations of metallic plates.

(1) Soft copper and a berillium-copper alloy (2) Soft copper and chromium (3) Soft copper and Hastelloy The porous thin foils of the present invention exhibited excellent performance when applied to practical uses.

(1) The effects of the porous thin foil of the present invention as used as an electromagnetic wave shielding material were the same as those of the conventional electromagnetic wave shielding materials. When an electromagnetic wave shield is formed by the porous thin foil of the present invention, the condition of the inside of the electromagnetic wave shield is visible through the fissures and also the employment of the porous thin foil of the present invention improves the appearance of the device. Since the porous thin foil of the present invention can be gold-plated or silver-plated, the conductivity of the porous thin foil can be enhanced by gold-plating or silver-plating.

(2) The performance of the porous thin foil of the present invention when used as a heating member was satisfactory. Since the porous thin foil of the present invention is able to form an extremely thin heating member, the same is most suitably applied to devices requiring a lightweight and compact construction.

(3) The porous thin foil of the present invention can be used in combination with a nonwoven fabric. For example, the porous thin foil of the present invention functions as an antistatic sheet when incorporated in a carpet or a rug.

As apparent from the foregoing description, the present invention provides porous thin foils capable of diversified uses and a method for manufacturing the same.

Although the invention has been described in its preferred form with a certain degree of particularity, it is to be understood by those skilled in the art that various changes and modifications may be made in the invention without departing from the spirit and scope thereof.

What is claimed is:

1. A porous thin foil formed by rolling a pair of first metallic plates having a second metallic plate inserted therebetween which has a smaller elongation percentage than the first metallic plates to create a plurality of through fissures extending between the opposite sides of the second metallic plate.

2. A method for manufacturing a porous thin foil comprising: a step of folding in half a first metallic plate having a large elongation percentage and inserting a second metallic plate having a small elongation percentage between the opposite folds of the folded first metallic plate; a step of cold-rolling the folded first metallic plate together with the second metallic plate inserted between the opposite folds of the folded first metallic plate; and a step of separating a porous thin foil formed from the second metallic plate from the folded first metallic plate after a plurality of cycles of cold-rolling.

3. A method for manufacturing a porous thin foil, according to claim 2, wherein said first metallic plate is a soft copper plate and said second metallic plate is a stainless steel plate.

4. A method for manufacturing a porous thin foil, according to claim 2, wherein said first metallic plate is a soft copper plate and said second metallic plate is a permalloy plate.

5. A method for manufacturing a porous thin foil, according to claim 2, wherein said first metallic plate is a soft copper plate and said second metallic plate is a beryllium-copper alloy plate.

6. A method for manufacturing a porous thin foil, according to claim 2, wherein said first metallic plate is a soft copper plate and said second metallic plate is a chromium plate.

7. A method for manufacturing a porous this foil, according to claim 2, wherein said first metallic plate is soft copper plate and said second metallic plate is a Hastelloy plate.

8. A method for manufacturing a porous thin foil comprising: a step of separating a pair of first metallic plates having a large elongation percentages and inserting a second metallic plate having a small elongation percentage between the first metallic plates; a step of cold-rolling the first metallic plates together with the second metallic plate inserted between the first metallic plates; and a step of separating a porous thin foil formed from the second metallic plate from the first metallic plates after a plurality of cycles of cold-rolling.

9. A method for manufacturing a porous thin foil, according to claim 8, wherein said first metallic plates are soft copper plates and said second metallic plate is a stainless steel plate.

10. A method for manufacturing a porous thin foil, according to claim 8, wherein said first metallic plates are soft copper plates and said second metallic plate is a permalloy plate.

11. A method for manufacturing a porous thin foil, according to claim 8, wherein said first metallic plates are soft copper plates and said second metallic plate is a beryllium-copper alloy plate.

12. A method for manufacturing a porous thin foil, according to claim 8, wherein said first metallic plates are soft copper plates and said second metallic plate is a chromium plate.

13. A method for manufacturing a porous thin foil, according to claim 8, wherein said first metallic plates are soft copper plates and said second metallic plate is a Hastelloy plate.

* * * * *